US005385278A

United States Patent [19]

Paul et al.

[11] Patent Number: 5,385,278

[45] Date of Patent: Jan. 31, 1995

[54] AUTOMATED TURNING AND PRESSING APPARATUS AND METHOD

[75] Inventors: Frank W. Paul, Seneca, S.C.; Shlomo Avigdor, Carmiel, Israel; Kishore Subba-Rao, Hickory, N.C.

[73] Assignee: Clemson University, Clemson, S.C.

[21] Appl. No.: 144,742

[22] Filed: Oct. 28, 1993

Related U.S. Application Data

[62] Division of Ser. No. 972,028, Nov. 5, 1992.

[51] Int. Cl.[6] ..... A41H 43/00; D06C 15/00

[52] U.S. Cl. ..... 223/2; 223/52.1; 223/61

[58] Field of Search ..... 223/2, 3, 4, 52.1, 52.5, 223/52.2, 52.6, 61, 63, 65, 74, 77, 42, 40, 39; 112/DIG. 2, DIG. 3, 306; 38/13, 20

[56] References Cited

U.S. PATENT DOCUMENTS

| | | | |
|---|---|---|---|
| 1,902,330 | 3/1933 | Kaplan | 223/61 |
| 3,112,847 | 12/1963 | Brumby | 223/2 |
| 3,125,261 | 3/1964 | Arbeter | 223/39 |
| 4,213,547 | 7/1980 | Conner, Jr. | 223/2 |
| 4,427,139 | 1/1984 | Depriest | 223/2 |
| 4,910,894 | 3/1990 | Vartan | 38/42 |
| 5,280,759 | 1/1994 | Scholl | 112/DIG. 2 |

FOREIGN PATENT DOCUMENTS

| | | | |
|---|---|---|---|
| 705523 | 4/1941 | Germany | 223/42 |

*Primary Examiner*—Clifford D. Crowder
*Assistant Examiner*—Bibhu Mohanty
*Attorney, Agent, or Firm*—Dority & Manning

[57] ABSTRACT

Method and apparatus for automated inverting and pressing of apparel components. A turning apparatus is provided for inverting run-stitched shirt collars or other apparel components and an automated pressing apparatus is provided for aligning a two-dimensional component so that a crease pressed therein will be located in the proper position.

1 Claim, 10 Drawing Sheets

AUTOMATED TURNING AND PRESSING APPARATUS AND METHOD

This is a division of application Ser. No. 07/972,028, filed Nov. 5, 1992, now pending.

BACKGROUND OF THE INVENTION

The present invention relates to apparel component handling and, more particularly, to automated turning and pressing of apparel components.

Numerous components are utilized in the apparel industry that require handling prior to completion of a final product. Such handling includes, for example, turning or inverting run-stitched apparel components as well as pressing apparel components for utilization in subsequent garments. Pressing of an apparel component or sub-assembly is an operation that affects the quality, appearance and marketability of the final apparel product.

Apparel products, or sub-assemblies, may be two-dimensional or three-dimensional. Examples of three-dimensional apparel products include suits, trousers, jackets and the like. Products such as suits, trousers and jackets are assembled from an array of smaller two-dimensional apparel sub-assemblies or components. For example, two-dimensional sub-assemblies for a dress shirt include the collar, sleeves, epaulets, pocket, and cuffs.

The present invention relates to handling of these two-dimensional components or sub-assemblies. While reference throughout is made to the collar of a dress shirt, such is for illustrative purposes only, and it should be understood by those of skill in the art that the present invention has applicability to a variety of two-dimensional apparel components or sub-assemblies.

Currently, special purpose machines exist for carrying out the turning and pressing of shirt collars. On the known commercial machines, turning and pressing is done one-half collar at a time, which is referred to as single point turning and pressing. Some disadvantages of these apparatus are that the quality of the crease generated is directly dependent on the operator's skill, and the entire collar is not uniformly pressed. Another disadvantage is the time involved in completion of a turning and pressing operation for each collar.

Other apparel component processing devices and methods are illustrated, for example, in U.S. Pat. Nos. 4,427,139, 4,093,498, 3,633,799, 4,213,547, 3,793,968, 3,780,682, 3,419,199 and 3,799,086.

SUMMARY OF THE INVENTION

The present invention recognizes and addresses the foregoing disadvantages, and others of prior art constructions and methods.

Accordingly, it is an object of the present invention to provide an improved two-dimensional apparel component turning apparatus and method.

It is another object of the present invention to provide an improved two-dimensional apparel component pressing apparatus and method.

It is another object of the present invention to provide an improved two-dimensional apparel component handling workstation for automated turning and pressing of two-dimensional apparel components such as shirt collars and the like.

It is a further object of the present invention to provide an apparatus and method for automated handling of apparel components such as shirt collars and the like.

It is another object of the present invention to provide an apparatus for inverting or turning shirt collars in a single operation.

It is another object of the present invention to provide an apparatus for aligning the plies of a two-dimensional apparel component so that a proper crease can be pressed therein.

It is another object of the present invention to provide a double point turning and pressing apparatus for improved efficiency and quality in turning and pressing shirt collars.

It is still another object of the present invention to provide an improved workstation for automated turning and pressing of apparel components.

These and other objects of the present invention are accomplished by providing an apparatus for inverting apparel pieces, such as shirt collars and the like, each of which comprises a plurality of superimposed plies seamed along an adjacent edge and unseamed along an opposite edge. The apparatus includes a support base and means for receiving an apparel piece to be inverted, the means for receiving being adapted to receive the apparel piece so that at least two of the unseamed edges of the piece are maintained in spaced apart relation. The apparatus also includes means for inverting the apparel piece, the means for inverting including first and second turning units attached to the support base and adapted to invert the entire apparel piece in one movement.

The means for receiving an apparel piece includes a bridge extending between the first and second turning units, and the turning units are pivotable with respect to the base and include a first apparel engaging member and a second apparel engaging member.

These and other objects of the present invention are also accomplished by a process for inverting run-stitched shirt collars and the like, each of which comprises a plurality of superimposed plies seamed along an adjacent edge and unseamed along an opposite edge and forming two collar points, the process including the steps of placing a run-stitched collar on a bridge supported on a base and extending between two turning units, the bridge including first and second spaced apart bridge members, the collar being placed so that at least two of the unseamed edges of the piece are maintained in spaced apart relation. The process further includes the step of engaging the collar points by moving first components of the turning units into contact with the interior of the collar points prior to inverting and further the step of engaging the collar points by moving second components of the turning units into contact with the exterior of the collar points prior to inverting. The process further includes the step of pivoting the turning units in opposite directions to carry the collar through the space formed between the first and second members of the bridge to thereby invert the run-stitched collar.

The features and objects of the present invention are also accomplished by providing an apparatus for automated pressing of two-dimensional apparel components, such as shirt collars and the like, each of which comprises a plurality of superimposed plies seamed along all but one adjacent edge, the apparatus comprising a frame, the frame including a support table for supporting an apparel component thereon. The pressing apparatus further includes a creaser blade mechanism movably mounted on the frame, the creaser blade mechanism adapted to move into the apparel component between two of the plurality of superimposed plies. The apparatus further includes means for aligning the superimposed plies of the apparel component so that when the apparel component is pressed, a properly located crease will be formed and means for pressing the apparel component.

These and other objects of the present invention are also accomplished by providing an automated apparel component inverting and pressing workstation including an apparatus for inverting apparel components, means for placing the apparel components on the inverting apparatus, means for moving the apparel components after inverting to an automated pressing apparatus, and an apparatus for automated pressing of the apparel components.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
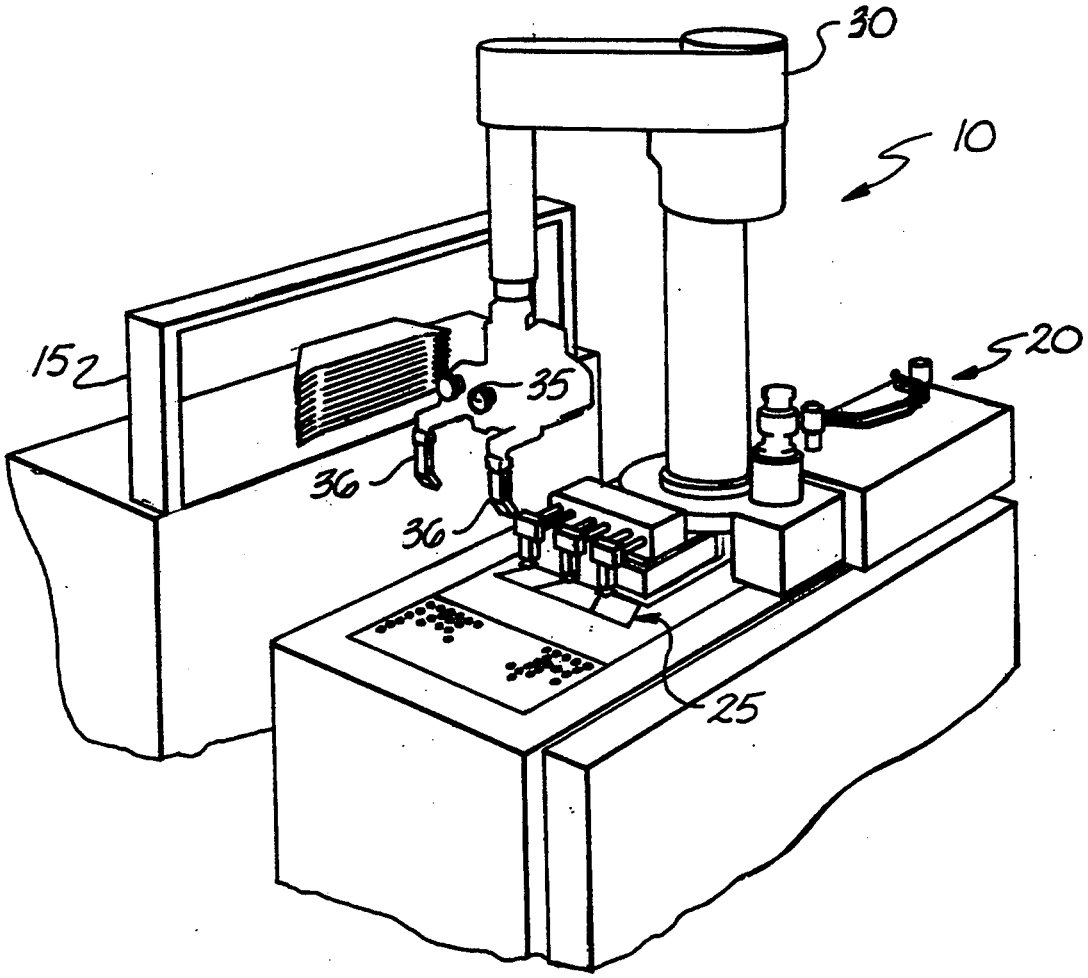
FIG. 1 discloses a perspective view of an automated apparel component inverting and pressing workstation in accordance with an embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Referring to FIG. 1, an automated apparel component inverting and pressing workstation is illustrated generally at 10. The automated apparel component inverting and pressing workstation 10 includes an-apparel component de-stacker 15, an apparatus for inverting apparel components 20, and an apparatus for automated pressing of apparel components 25. The automated apparel component inverting and pressing workstation further includes means for placing the apparel components on the inverting apparatus and means for moving the apparel components after inverting to the automated pressing apparatus. As embodied herein and illustrated in FIG. 1, the means for placing and means for moving may be an industrial robot 30 with an end effector 35 adapted for manipulating two-dimensional apparel components. End effector 35 may include grippers 36 for handling the two-dimensional apparel components. In addition, de-stacker 15 may be any device that separates the two-dimensional apparel components to allow for end effector 35 to retrieve the apparel component.

As discussed herein, two-dimensional apparel components may include any apparel component that is made up of a plurality of superimposed plies seamed together in some manner. For illustrative purposes, throughout this description, a two-dimensional apparel component in the form of a shirt collar will be described and referred to. Such description is not intended and should not be construed as limiting in any manner the scope of the present invention.

Figure 2:
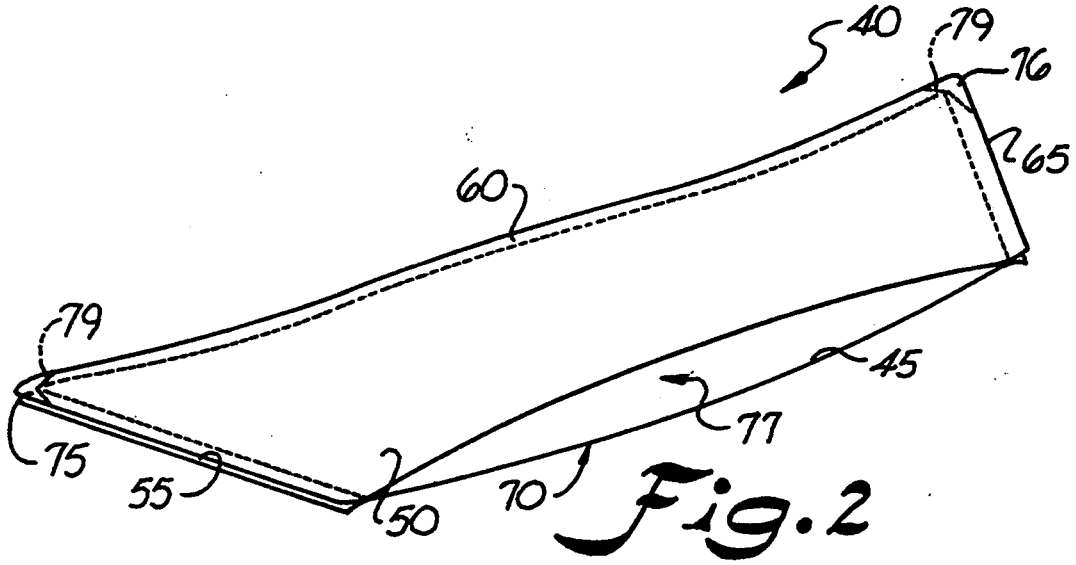
FIG. 2 discloses a two-dimensional apparel component that has been stitched along three sides and is representative of a run-stitched shirt collar.

Referring to FIG. 2, a run-stitched shirt collar 40 is illustrated. In general, a shirt collar consists of two plies which are sewn together along three sides as illustrated in FIG. 2. One of the plies has a fused lining for stiffening. After stitching the collar around the three sides, two corners, or collar points, 75, 76 are formed as shown in FIG. 2. The two plies form an inner pocket 77, and it is desirable to conceal the stitched seam edge. Therefore, the collar must be inverted inside out or turned as shown in sequence in FIGS. 2–4. With more specific reference to FIG. 2, collar 40 includes a lower ply 45 and an upper ply 50 arranged in superimposed orientation. Lower ply 45 and upper ply 50 are seamed together about its edge along a first side 55, second side 60 and third side 65. Adjacent edges along a fourth side 70 are unseamed so that run-stitched shirt collar 40 forms a pocket-like opening or space 77 between the superimposed plies. As further illustrated in FIG. 2, the run-stitched collar 40 includes first and second collar points 75, 76 formed at the corners of the first side and second side and at the second side and third side. As illustrated in FIG. 2, a notch 79 is trimmed in the corners of the untrimmed collar so that when the collar is inverted, there will be less material at the points and a better point can be obtained.

Figure 3:
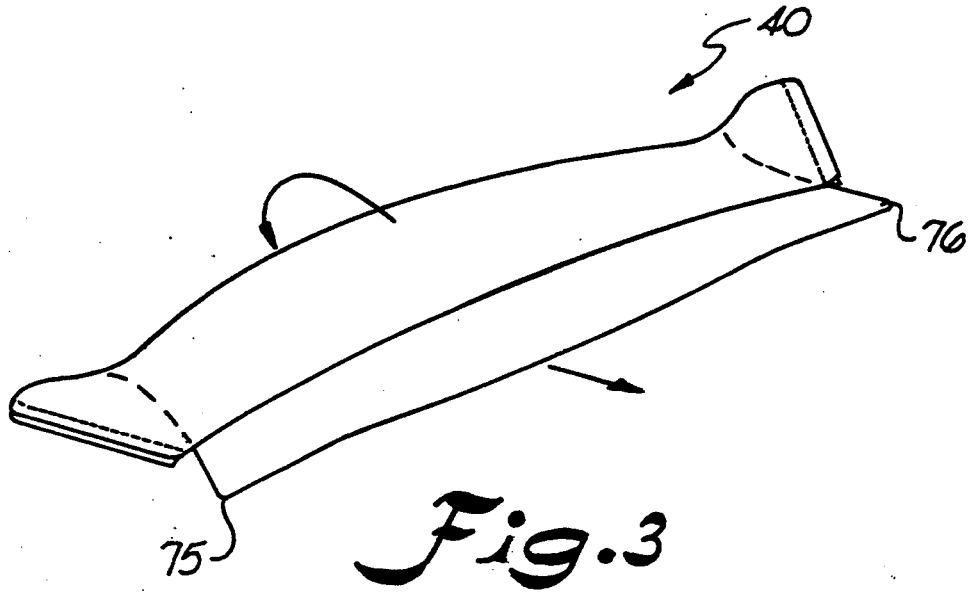
FIG. 3 illustrates a perspective view of an embodiment of FIG. 2 showing the collar being inverted.
Figure 4:
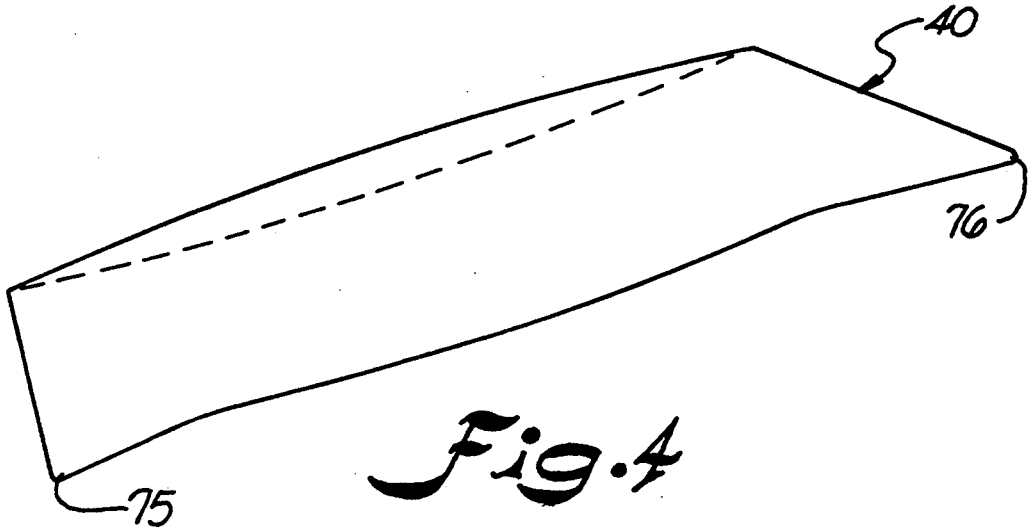
FIG. 4 illustrates a perspective view of the embodied two-dimensional apparel component of FIG. 2 after it has been turned inside out or inverted.

FIG. 3 illustrates run-stitched shirt collar 40 as it is being turned inside out or inverted. As illustrated in FIG. 3, first and second collar points 75 and 76 are pulled through the pocket formed by the superimposed plies so that the collar is turned inside out. As illustrated in FIG. 4, once the collar 40 has been inverted or turned inside out, the seam is hidden on the inside of the collar, and the collar is ready to be pressed and incorporated into a shirt.

Figure 5:
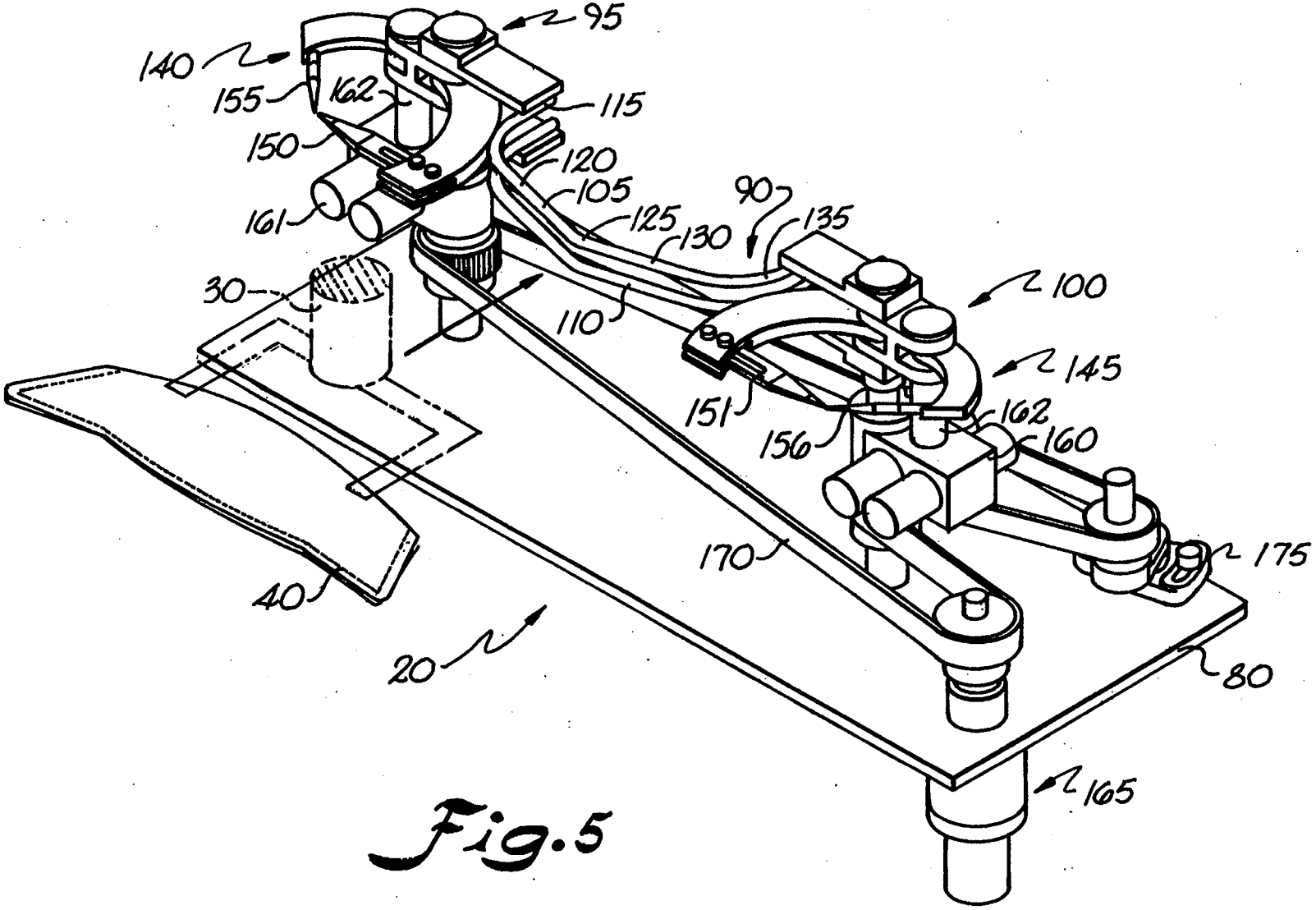
FIG. 5 is a perspective view of an apparatus for inverting apparel components in accordance with an embodiment of the present invention.

FIG. 5 illustrates in detail the components of an apparatus for inverting apparel components 20 in accordance with the present invention. Apparatus for inverting apparel components for shirt collars and the like 20 includes a support base 80 and a means for receiving an apparel piece or component to be inverted. As embodied herein, the means for receiving an apparel piece to be inverted is illustrated generally at 85. The means for receiving an apparel piece 85 includes a bridge 90 extending between a first turning unit 95 and a second turning unit 100. Bridge 90 includes a first bridge member 105 and second bridge member 110. First and second bridge members 105 and 110 are arranged substantially parallel and spaced apart, one above the other.

Each bridge member 105 and 110 includes a first portion 115 extending in a first direction, a second portion 120 angled from said first portion 115 and extending to a point 125. Each bridge member then angles in an opposite direction through a portion 130 which curves into portion 135 that attaches to the other turning unit. Point 125 on bridge members 105 and 110 is in the middle of each bridge member with each portion of the bridge extending on opposite sides of point 125 being a mirror image of the other.

In addition, first bridge member 105 and second bridge member 110 are mirror images of each other. This configuration of the bridge allows for receipt and turning of the run-stitched apparel collars. The first and second bridge members 105 and 110 are spaced apart so that when a collar or other apparel component is received thereon and engaged by the means for inverting the apparel piece, the apparel piece will be taken through the space between first bridge member 105 and second bridge member 110 to therefore cause turning of the apparel component. Of course, the exact configuration of the bridge will vary depending on the apparel component to be inverted.

The present invention further includes means for inverting the apparel component or shirt collar. As embodied herein, the means for inverting includes first turning unit 95 and second turning unit 100, which turning units are attached to support base 80. Each turning unit 95 and 100 is pivotal with respect to base 80 and includes support brackets 140 and 145. Each support bracket includes a first apparel engaging member 150, 151 and a second apparel engaging member 155, 156. Second apparel engaging members 155, 156 are pivotal with respect to first apparel engaging members 150, 151 so that second apparel engaging members may open with respect to first apparel engaging members and the first apparel engaging members can be received within the pocket or open area formed by the run-stitched shirt collar. Thereafter, second apparel engaging members 155, 156 pivot closed to maintain the points of the run-stitched shirt collar in proper orientation during the inverting or turning process. Actuators 160, 161 are operative through shafts 162 to cause pivoting of second apparel engaging member 155, 156 with respect to the remainder of the turning unit. Actuators 160, 161 may be any type of actuating mechanism to cause second apparel engaging members 155, 156 to pivot with respect to first apparel engaging members.

In addition, turning units 95 and 100 rotate or pivot with respect to base 80 as will be described in more detail with respect to FIGS. 6 through 9. A drive means 165 operates through belt 170 to cause turning units 95, 100 to rotate or pivot in opposite directions simultaneously for inverting the apparel components. Adjustment mechanism 175 can be used to adjust the belt drive mechanism as illustrated in FIG. 5. As embodied herein, drive means 165 is a stepper motor. It should be appreciated by one skilled in the art that drive means 165 could be embodied as any suitable drive or actuator such as a DC servomotor, a pneumatic servomotor or any other kind of known drive or actuator. In addition, it should be understood that it is within the scope of the present invention to utilize any type drive mechanism to cause turning or inverting units 95 and 100 to pivot. For example, a four-bar mechanism or the like could be utilized to cause the turning units 95 and 100 to rotate.

FIG. 5 also illustrates industrial robot 30 prior to placing run-stitched collar 40 onto bridge 90. As can be seen from FIG. 5, end effectors 35 of robot 30 grip the upper ply of run-stitched collar 40 so that the lower ply is allowed to fall open and the end effector can place the run-stitched collar over the bridge with one ply above the upper bridge member and one ply below the lower bridge member so that a portion of the turning mechanism can be received within the pocket formed by the run-stitched collar.

Figure 6:
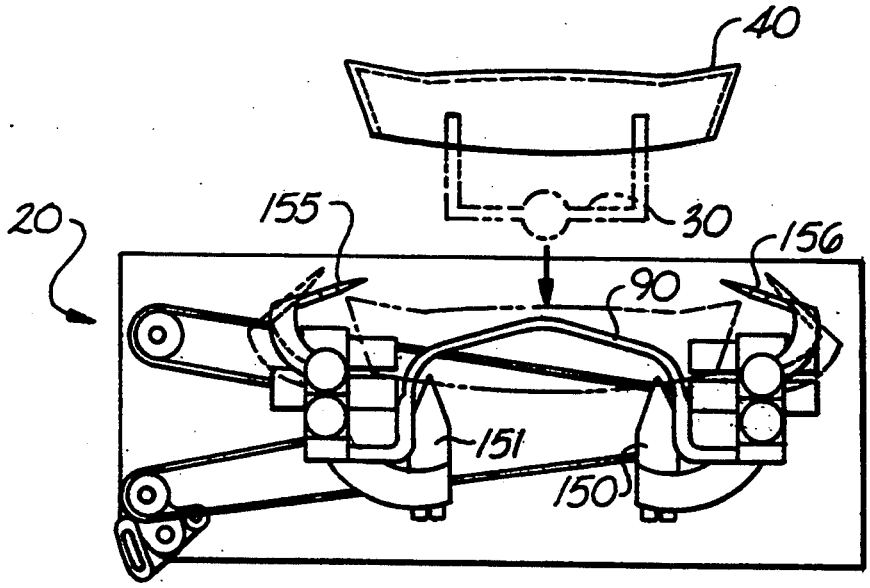
FIG. 6 is a top schematic view showing one step in the operation of the apparatus for inverting apparel components of FIG. 5.

FIG. 6 illustrates the apparatus for inverting apparel components 20 in position to receive a run-stitched collar 40 from robot 30. Of course, any manner of placing the run-stitched collar onto the bridge of the inverting apparatus would be well within the scope of the present invention. As illustrated in FIG. 6, the apparatus for inverting apparel components 20 has its turning units pivoted and oriented in such a manner to be ready to receive run-stitched shirt collar 40 or other apparel component thereon. As set forth above, collar 40 is placed with one ply over first bridge member 105 and with the other ply under second bridge member 110 so that bridge 90 is received within the pocket formed by the seams maintaining the superimposed plies of the collar together. As illustrated in FIG. 6, first apparel engaging members 150 and 151 are pivoted so as to be located on the opposite side of the bridge from the side where the run-stitched collar is placed. Second apparel engaging members 155, 156 are pivoted to an open position so that collar 40 can be received on bridge 90 without interference from second apparel engaging members 155, 156.

Figure 7:
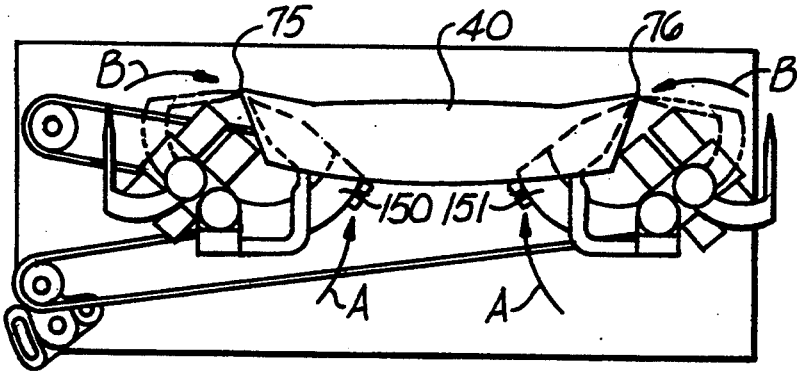
FIG. 7 illustrates a top view of the apparatus set forth in FIG. 6 in a subsequent step of the inverting process.

Referring to FIG. 7, after collar 40 is placed on bridge 90, first apparel engaging members 150, 151 are pivoted in the direction of arrows A so as to engage inside the pocket of collar 40 and into the collar points 75, 76. Thereafter, forced air may be applied at collar points 75, 76 to force them in a direction so that the entire pressure of the first apparel engaging members and the second apparel engaging members is not directed immediately on the seam. It is desired to have the force of first and second apparel engaging members directed against the ply of the collar that has the fused lining, rather than directly into the seam at the collar points. The forced air may be provided by any known means such as, for example, compressed air supplied through a tube with its exit located near the point of contact of the collar and the second apparel engaging means.

After first apparel engaging members 150, 151 have pivoted into engagement with the interior of said collar as illustrated in FIG. 7, second apparel engaging members 155, 156 pivot in the direction of arrows B so as to clamp near the point areas 75, 76 of collar 40 between first apparel engaging members 150, 151 and second apparel engaging members 155, 156.

Figure 8:
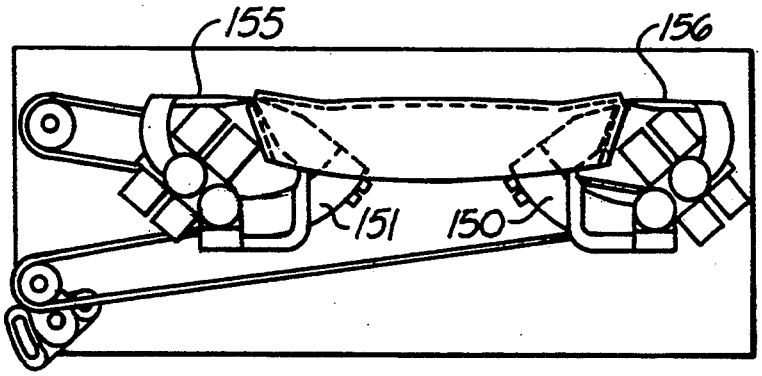
FIG. 8 illustrates a top view of the apparatus embodied in FIG. 6 in yet another subsequent step of the inverting process.

FIG. 8 illustrates the inverting apparatus after the apparel engaging members have been pivoted into position for inverting. As illustrated in FIG. 8, second apparel engaging members 155, 156 engage the collar slightly off the points 175, 176 so that the contact and forces will not be applied directly to the seam. Of course, any method or structure to prevent the force from being applied directly to the seam would be within the scope of the present invention.

Figure 9:
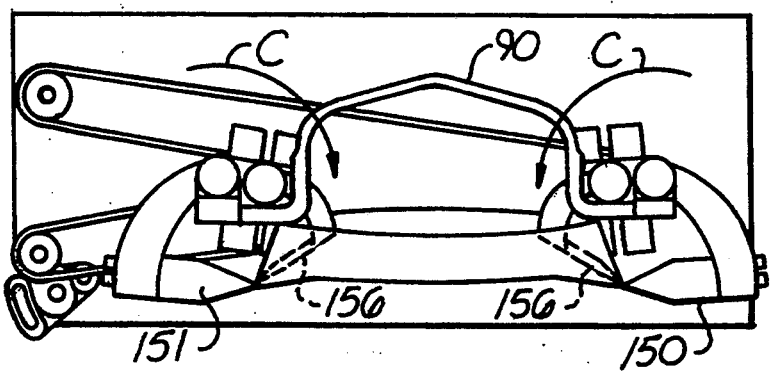
FIG. 9 illustrates a top view of the apparatus set forth in FIG. 6 after the inverting process for an apparel component has been completed.

Thereafter, to complete the turning process, turning units 95 and 100 are rotated or pivoted in the direction of arrows C so as to cause each turning unit to pivot in the opposite direction. Upon pivoting of turning units 95, 100 in opposite directions after the first and second apparel engaging members are in place, collar 40 will be pulled through the space formed between the first and second bridge members and therefor inverted or turned inside out as best illustrated in FIG. 9. After such inverting, the collar may be removed manually for further processing, or may be removed by a means for moving the apparel components. As illustrated herein, the means for moving apparel components may include robot 30 with end effector 35 that has previously been described with respect to FIG. 1.

Figure 10:
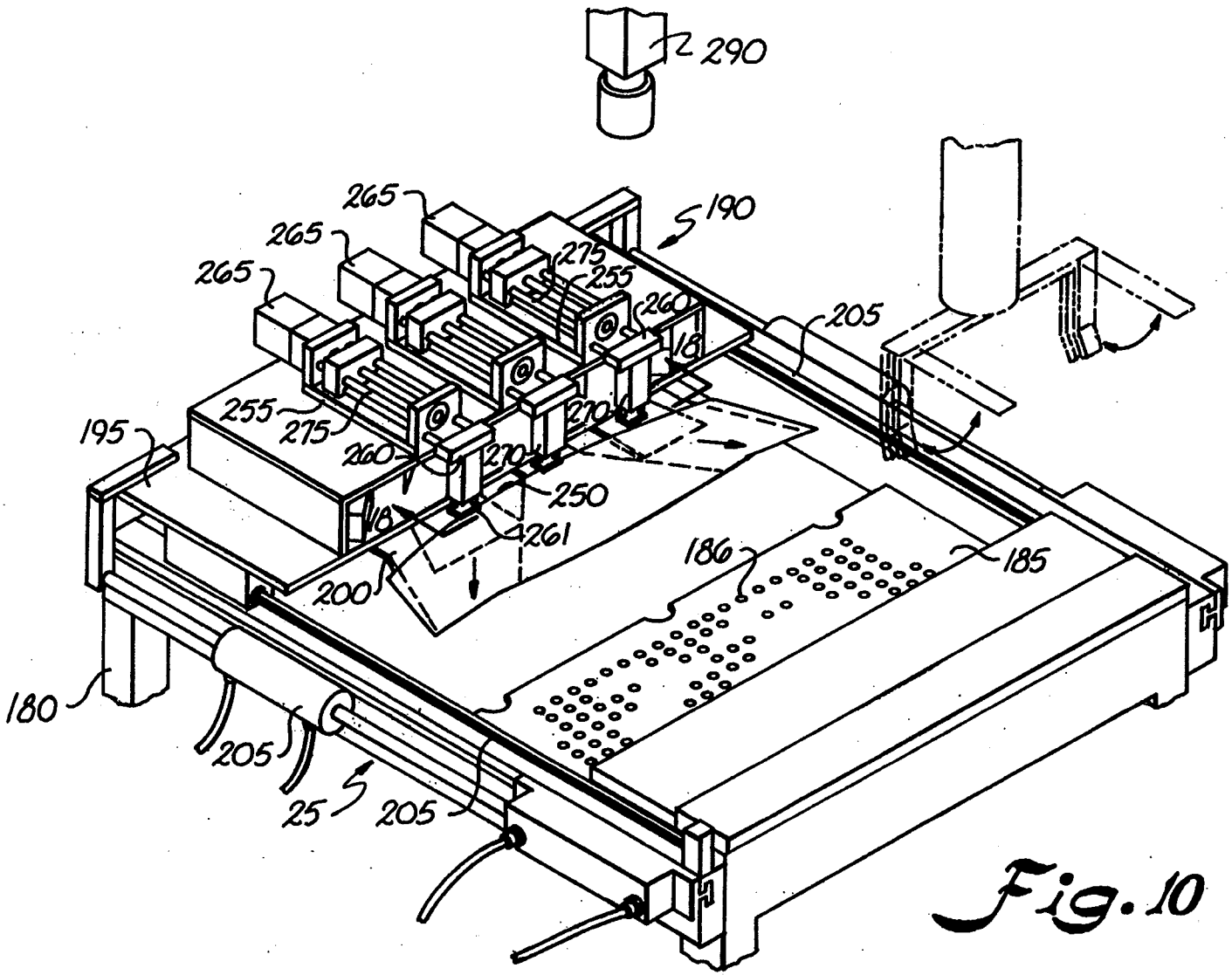
FIG. 10 is a perspective view of an apparatus for automated pressing of apparel components in accordance with an embodiment of the present invention.

As illustrated in FIG. 1, the automated apparel component inverting and pressing workstation 10 also includes an apparatus for automated pressing of apparel components generally illustrated at 25 in FIGS. 1 and 10. Referring specifically to FIG. 10, the apparatus for automated pressing of apparel components 25 includes a frame 180. The frame includes a support table 185 for supporting an apparel component such as shirt collar 40 thereon. Support table 185 may be a vacuum table and includes means for creating suction on the surface of the table through holes 186 located in the table. Any conventional means for creating a vacuum at the surface of table 185 would be well within the scope of the present invention.

As further illustrated in FIG. 10, the automated pressing apparatus includes a creaser blade mechanism generally illustrated at 190. Creaser blade mechanism 190 includes a support member 195 that supports a creaser blade 200. Creaser blade mechanism 190 is adapted to move forward and away from vacuum table 185 so as to move creaser blade 200 into and out of a collar 40 placed on vacuum table 185. In one embodiment of the present invention, support member 195 includes portions that receive guide rods 205 on which support member 195 is guided by pneumatic means 205 toward and away from vacuum table 185. Of course, any method of guiding or moving creaser blade mechanism 190 into and out of a collar 40 placed on table 185 would be well within the scope of the present invention and the described embodiment is by way of illustration only. Creaser blade mechanism 190 includes means for substantially conforming to the shape of the apparel component when the creaser blade mechanism is moved into the apparel component. As embodied herein, this conforming means includes a creaser blade 200.

Figure 11:
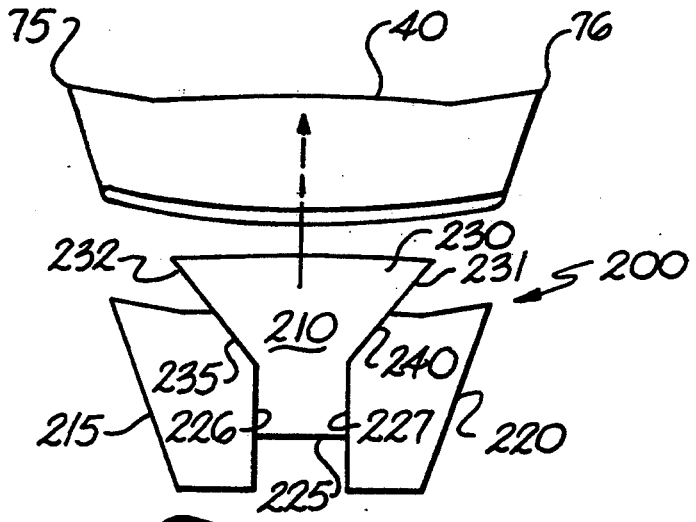
FIG. 11 is a top detailed view of a creaser blade prior to insertion into an apparel component.
Figure 12:
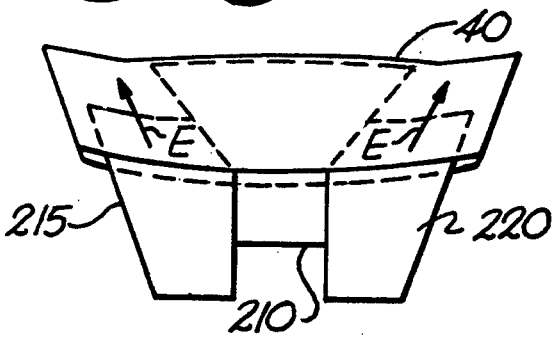
FIG. 12 is a top view of the creaser blade partially inserted into an apparel component.
Figure 13:
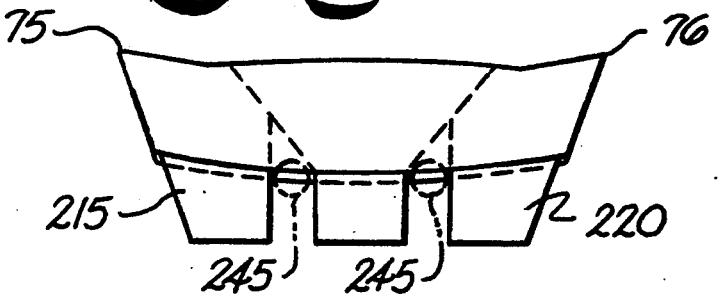
FIG. 13 is a top view of the creaser blade completely inserted into an apparel component.

Referring to FIGS. 11–13, creaser blade 200 is shown in detail as it is utilized to enter into the pocket formed by inverted collar 40. Creaser blade 200 includes a middle blade 210 and two side blades 215 and 220. Middle blade 210 includes a first portion 225 with substantially straight edges 226, 227. Middle blade 210 includes a second portion 230 with angled edges 231 and 232. Side blades 215 and 220 include angled edge portions 235, 240 that engage the angled edges 231, 232 of middle blade 240 to control the course of movement of side blades 215, 220 when they are actuated. Arrows E in FIG. 12 illustrate the direction of movement of side blades 215, 220 when they are actuated to move into a collar 40. FIG. 13 illustrates the orientation of creaser blade 200 when it has been moved completely into collar 40 and side blades 215, 220 have also been moved to their fully extended positions. The entry location of a shirt collar is of less width than the distance between the collar points 75, 76. The three-section creaser blade 200 of the present invention allows the creaser blade to enter a shirt collar. The slidable side blades 215, 220 are engaged to move along the angled portion of middle blade 210 so as to move into contact with collar 40 maintaining the points in proper orientation.

As best illustrated in FIG. 13, because of the shape of side blades 215, 220 and middle blade 210, when side blades are in their fully engaged position, viewing spaces 245 are provided whereby a vision sensor can view the relationship between the upper and lower plies without interference by the creaser blade as will be discussed in greater detail below.

The operation of creaser blade mechanism 190 is as follows. A turned or inverted collar ready for pressing is placed on vacuum table 185 and vacuum is applied to maintain the lower ply of the collar 40 secure to table 185. The mechanism that places the collar onto the vacuum table maintains the upper ply in spaced apart relation with respect to the lower ply to thereby form an opening or pocket for receipt of creaser blade 200. Creaser blade mechanism 190 is then moved toward the opening of collar 40. As illustrated in FIGS. 11–13, creaser blade is then moved into the opening in the collar and the side blades 215, 220 are actuated to cause the collar to be properly located on the creaser blade. The creaser blade is propelled by an air cylinder moving the portions of the blade. At this point, it is necessary to properly align the collar on the creaser blade so that a proper crease can be pressed therein.

In the case of a dress shirt collar, the upper and lower plies are identical in shape. Before the plies are sewn together, the rear edges of the plies are aligned by the operator. Applying the principles of indirect sensing and control for automated seam alignment, it is possible to predict the position of points on the seam by monitoring the location of points on the free edge of the upper and lower plies of the turned collar. If one of the plies is clamped and forced to remain stationary, then the seam alignment task by indirect sensing is similar to a task of folding an apparel workpiece over a creaser blade. This will enable the seam alignment task to be carried out by manipulating the upper ply alone.

Referring again to FIG. 10, the apparatus for pressing includes means for moving the unseamed edges of the plies into alignment. As embodied herein, the means for moving the unseamed edges of the plies into alignment includes means for clamping at least one of the edges of the plies, means for moving at least one of the edges of the plies, and means for indicating when the clamped edge and the moved edge are aligned.

As embodied herein and illustrated generally in FIG. 10, the means for moving at least one of the edges of the ply of the collar 40, which edge in the embodiment illustrated in FIG. 10 would be the top edge 250, includes at least one, and preferably a plurality of, devices for making contact with the upper ply of the collar.

As embodied herein, a plurality of linear actuators 255 is utilized to impart motion in two directions to a friction pad assembly 260. Friction pad assembly 260 includes friction pads 261. Linear actuators 255 include drive motors 265 for moving the friction pad assemblies in the same direction as the creaser blade mechanism moves thus allowing the friction pad assemblies, when engaged with the upper ply to move the upper ply forward and backward until it is aligned with the bottom edge or the edge on the lower ply. Pneumatic means 270 actuate friction pad assembly to move friction pads 261 in a direction perpendicular to the direction of movement of the creaser blade mechanism so as when actuated to make frictional engagement with the upper ply of collar 40. Linear actuators 255 may include a ball screw and nut type assembly 275 whereby the rotary output of the drive motors 265 may be converted into linear movement of the friction pad assembly 260 as will be described in greater detail with respect to other figures.

Figure 14:
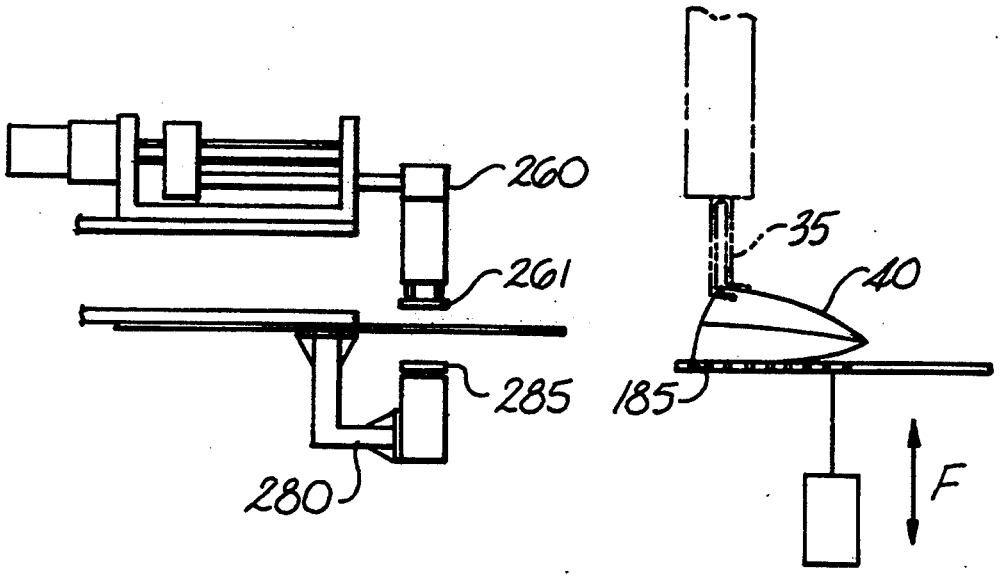
FIG. 14 is a side view of selected components of the automated pressing apparatus prior to the insertion of the creaser blade into the apparel component.
Figure 15:
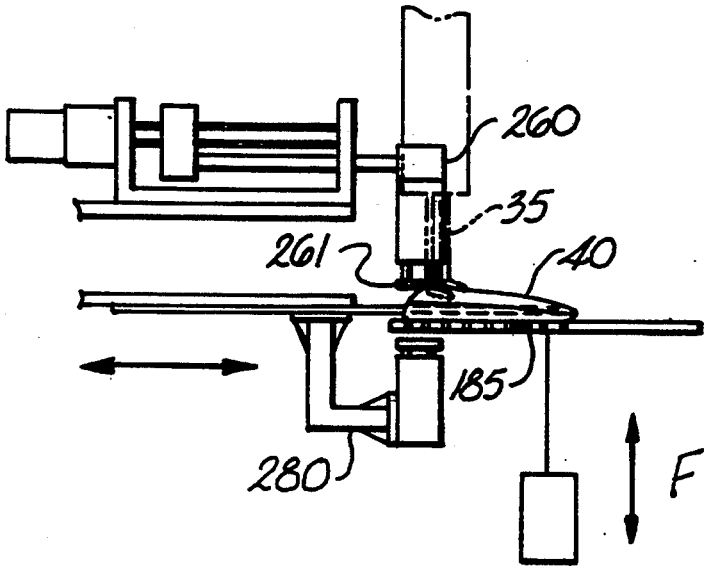
FIG. 15 is a side view as set forth in FIG. 11 illustrating the position where the creaser blade mechanism has been inserted into the apparel component.

Referring to FIGS. 14 and 15, a side schematic view of the means for moving at least one of the edges and the means for clamping is illustrated. As embodied herein, the means for clamping at least one of said edges includes a pneumatic clamping mechanism 280. Pneumatic clamping mechanism 280 includes pneumatically actuated friction pads 285 that may be actuated to move in a direction substantially perpendicular to the direction of movement of the creaser blade mechanism. Friction pads 285 are used to engage the lower ply against the bottom portion of the creaser blade mechanism to maintain the edge of the lower ply of the collar in a static position while the upper edge is aligned by the linear actuator 255 and friction pad assembly 260.

Figure 17:
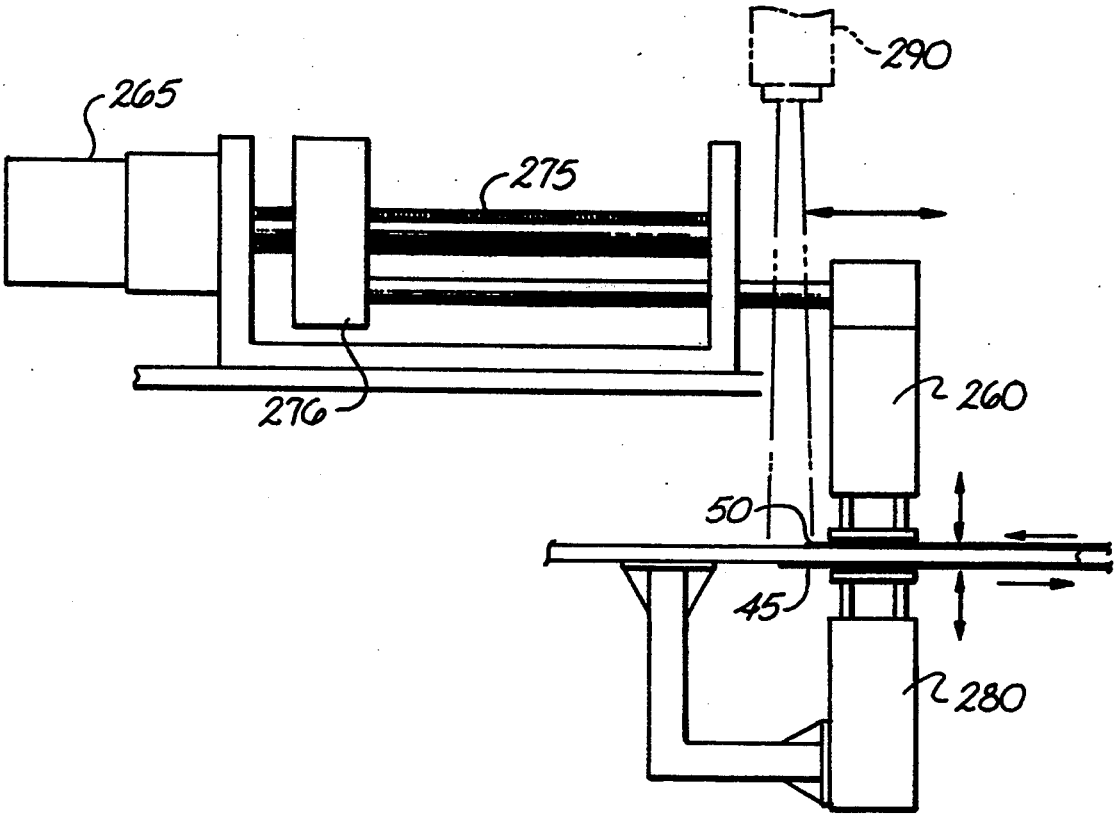
FIG. 17 is a side view illustrating the clamping and aligning apparatus of the automated pressing device.
Figure 18:
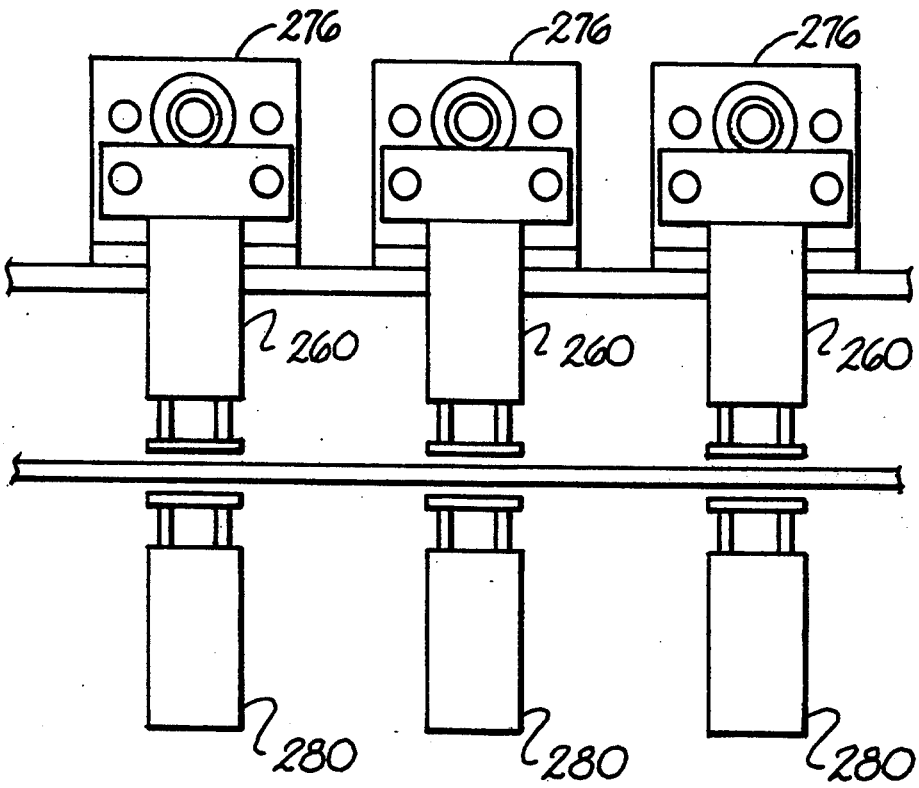
FIG. 18 is a front view of selected aspects of the automated pressing device illustrating the linear actuators and clamping devices.

As best illustrated in FIG. 14, a collar 40 is maintained in open position with its top ply maintained by end effectors 35 and its bottom ply held in position by the suction forces of vacuum table 185. As creaser blade mechanism 190 moves creaser blade 200 into the opening in collar 40, vacuum table 185 is removed in a direction as illustrated by arrow F in FIGS. 14 and 15. After the vacuum table is moved away, pneumatic clamping mechanism 280 is actuated to place friction pads 285 into contact with the lower ply of collar 40 to thereby maintain the edge of the lower ply of collar 40 in place. As illustrated in FIGS. 15 and 17, the end effector 35 then releases the upper ply and the friction pad assemblies 260 are moved into place and engage the upper ply of collar 40. After such engagement, means for indicating alignment between the unseamed edge of the lower ply 45 and the upper ply 50 are activated. Of course, upper and lower are utilized merely as references and are not intended as any orientational limitation.

Figure 16:
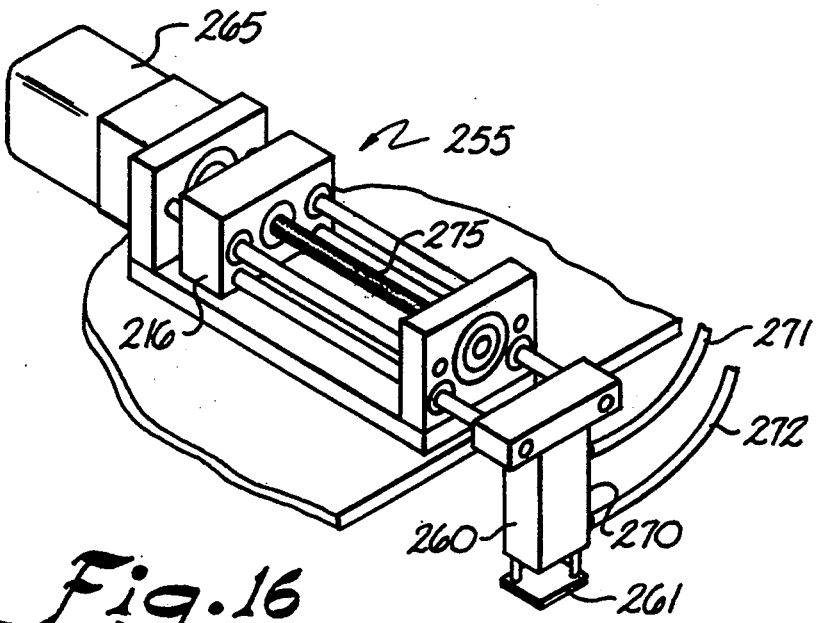
FIG. 16 is a perspective view of a linear actuating and clamping device in accordance with an embodiment of the present invention.

Referring to FIG. 16, linear actuators 255 are described in detail. Linear actuators 255 include friction pad assemblies 260 with friction pads 261 movably attached thereto. Drive motors 265 are utilized to impart rotational motion to threaded drives 275 which engage with threaded locks 276 so as to convert the rotary motion of motors 265 into linear movement of friction pad assemblies 260. Friction pad assemblies 260 include pneumatic means 270 with pneumatic input lines 271 and output lines 272 driving an internal cylinder of pneumatic means 270 to cause movement of friction pad 261 out of and into engagement with upper ply 50 of collar 40. When friction pads 261 are actuated to engage upper ply 50 of collar 40, drive motors 265 may then be actuated to move friction pad assemblies 260 back and forth in the same direction of movement of the creaser blade assembly. Since clamping means 280 maintain lower ply 45 in a fixed position, friction pad assembly 260 being moved by linear actuators 255 in accordance with the direction of vision sensor 290 controls the alignment of the unseamed edge of lower ply 45 with the unseamed edge of upper ply 50. When such edges are aligned, the collar will be located on the creaser blade such that it will be ready to be pressed to make a proper crease on the collar.

As embodied herein, a vision sensor may be utilized for determining the proper alignment of the edges of the lower ply 45 and upper ply 50. In one embodiment of the present invention, a conventional range data scanner can be utilized to determine the location of the collar for proper placement on the vacuum table. Based on feedback from the range data scanner, the end effector can be directed to place the collar in a particular location. Thereafter, a conventional vision sensor, such as a CCD camera as manufactured by Panasonic Industrial Company in Norcross, Ga., can be utilized to view and direct the matching of the ply rear edges. The vision sensor can view the edges at the viewing locations 245 where portions of the side blades are not adjacent the middle blade. Of course, it should be understood by those skilled in the art that any type of alignment feedback means could be utilized in accordance with the other aspects of the present invention. For example, it is also possible to utilize optical types of sensors such as, for example, sets of linear arrays of LED sensors. In such an embodiment, one set of LED sensors could be used to do the initial location as described above with respect to the range data scanner and another set of LED sensors could be used for the edge alignment function.

With respect to the means for pressing of the present invention, block pressing is a process in which the fabric for component envelops a fixed form, called the block, before pressure, heat or moisture is applied to the fabric in order to stabilize the fabric's conformance to the shape and form of the block. Block pressing is used to press the apparel component, and the creaser blade forms the block with its profile matching that of the collar run stitch. The particular pressing device can be of any conventional nature suited to the type block utilized in the present invention.

It should also be noted that it would be possible to incorporate the turning and pressing apparatus as disclosed herein into a single machine. It should also be noted that the present invention may be adapted to various sizes and styles of collars or two-dimensional workpieces without departing from the spirit and scope of the present invention. In addition, it should be noted that the turning embodiment or the pressing embodiment could be incorporated into existing turning or pressing apparatus. Furthermore, these and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. An automated apparel component inverting and pressing workstation, said apparel components each comprising a plurality of superimposed plies seamed along all but one adjacent edge, said workstation comprising:

a) an apparatus for inverting apparel components, said apparatus including a support base and means for receiving an apparel component to be inverted, said means for receiving being adapted to receive said component so that at least two of said unseamed edges of said component are maintained in spaced apart relation;

said apparatus further including means for inverting said apparel component, said means for inverting comprising first and second turning units attached to said support base and adapted to invert the entire apparel component in one movement;

b) means for placing said apparel components on said inverting apparatus;

c) means for moving the apparel components after inverting to an automated pressing apparatus;

d) an apparatus for automated pressing said apparel components, said apparatus including a frame, said frame including a support table for supporting an apparel component thereon;

said apparatus for automated pressing further including a creaser blade mechanism movably mounted on said frame, said creaser blade mechanism adapted to move into said apparel component between two of said plurality of superimposed plies, and means for aligning the superimposed plies of said apparel component so that when said apparel component is pressed, a properly located crease will be formed.

* * * * *